United States Patent [19]

Rölli

[11] Patent Number: 4,947,013

[45] Date of Patent: Aug. 7, 1990

[54] APPARATUS FOR THE GUIDING OF CAN BODIES OF A NON-CIRCULAR CROSS-SECTION

[75] Inventor: Hans Rölli, St. Blaise, Switzerland

[73] Assignee: Fael S.A., Saint-Blaise, Switzerland

[21] Appl. No.: 333,245

[22] Filed: Apr. 5, 1989

[30] Foreign Application Priority Data

Apr. 29, 1988 [CH] Switzerland ..... 1614882

[51] Int. Cl.[5] ..... B23K 11/00

[52] U.S. Cl. ..... 219/64; 413/71

[58] Field of Search ..... 219/6 H, 60.2; 413/70, 413/71, 72, 73; 72/199

[56] References Cited

U.S. PATENT DOCUMENTS

| | | | |
|---|---|---|---|
| 3,328,989 | 7/1967 | Stephan | 72/199 |
| 3,591,756 | 7/1971 | Timko | 219/64 |
| 4,675,489 | 6/1987 | Opprecht | 219/64 |

*Primary Examiner*—Clifford C. Shaw

*Attorney, Agent, or Firm*—Laurence R. Brown

[57] ABSTRACT

The guiding apparatus for a body for the production of can bodies having a non-circular cross-section by interconnecting the edges of the body by means of making a longitudinal seam comprises at both of the mutually opposite sides of the body supported symmetrically at circumferential areas two respective supporting rollers operative for a guiding of the body at the height of the edges to be welded and which are supported by their axes of rotation in succession relative to the direction of feed of the body in a rocker. These rockers are pivotably mounted at one end of a double arm transmission lever such that the supporting rollers operating as guides for the bodies abut continuously uniformly the further fed body for a tapering can body. A small pressing force is maintained by a pneumatic cylinder coupled to the other end of the transmission lever. Seen in direction of feed a pressing roller is located after the supporting rollers and pressed with a larger force by means of a transmission lever and a further pneumatic cylinder which is controlled independently from the other cylinders against the body in order to counteract the larger forces prevailing during the producing of the longitudinal seam for instance by welding electrode rollers. The precise guiding along the entire length of the body secures an impeccable production of a longitudinal seam in case of a non-circular cross-section.

7 Claims, 1 Drawing Sheet

FIG. 1
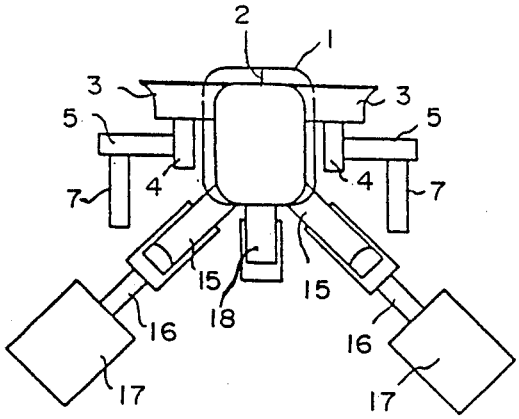
FIG. 2
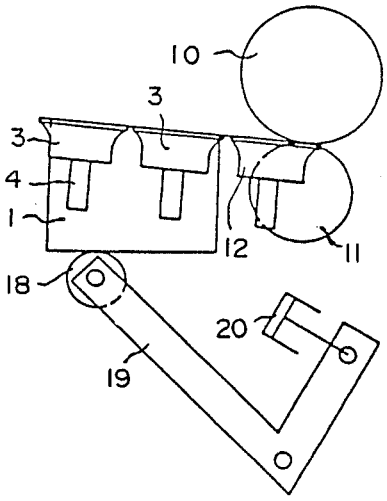
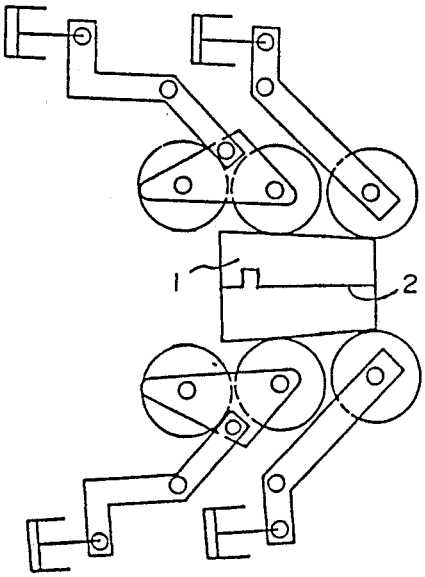
FIG. 4
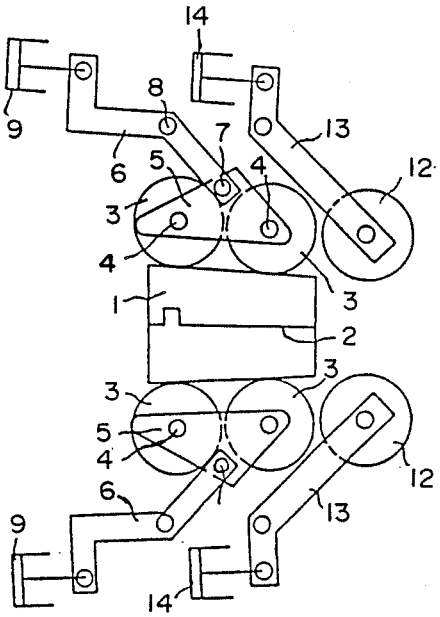
FIG. 3

APPARATUS FOR THE GUIDING OF CAN BODIES OF A NON-CIRCULAR CROSS-SECTION

BACKGROUND OF THE INVENTION

1. Field of the Invention

The present invention relates to an apparatus for the guiding in a machine of can bodies having a noncircular cross-section and specifically a cross-section which is variable in the longitudinal extent of the can in a machine, in which machine the edges of the bodies which are fed by a feeding mechanism are interconnected at the end of the path of feed by a producing of longitudinal seam during which the edges of the bodies are maintained by guiding members in an overlapping state as required for such longitudinal seam.

2. Description of the Prior Art

In order to produce cans having a circular cross-section by forming a longitudinal seam on pre-shaped can bodies it is generally known to use at the can end of a feeding path within a machine in which the bodies are pre-shaped from blanks and arrive at a working station for interconnecting the edges of the bodies by forming a longitudinal seam, a so called calibrating ring through which the body is moved during the producing of the longitudinal seam for instance by a resistance roll welding, by means of which ring the body is held in the exactly correct position for the producing of the longitudinal seam.

Such a calibrating ring can, however, not be used in case of can bodies having a non-circular cross-section, for instance a substantially rectangular cross-section having rounded corners and where additionally the size of the cross-section changes along the longitudinal extent of such can body which features for instance a conicity or taper.

It is basically possible, however, to also produce can bodies having a non-circular cross-section in accordance with a similar principle such as is known for cans having a circular cross-section by proceeding from planar blanks where all deforming steps for the rounded corners are made in a machine as well as the feeding up to a working station for interconnecting of the edges of the bodies by forming a longitudinal seam to which end due to the cross-section of the can deviating from the circular shape very particular feeding mechanisms are needed.

Additionally, a special device for the guiding of the bodies is necessary for the last leg of the path of feeding within the machine such that the longitudinal seam can be produced in a precise execution.

SUMMARY OF THE INVENTION

A general object of the invention is to provide an apparatus for the guiding of can bodies having a noncircular cross-section.

A further object of the invention is to provide an apparatus comprising respective pluralities of rollers located at every one of the oppositely located sides of the body supported symmetrically at circumferential areas and operative for guiding the body in the area of the edges to be welded together, which rollers are supported on supports which due to the action of a controllable force which can be kept at a constant value to maintain the rollers in a pressing position which is automatically adjustable laterally relative to the direction of feed.

The advantage of the apparatus structured in accordance with the invention is that the body is guided by a plurality of supporting rollers at both opposite sides of the body and along the entire length thereof and that also in case of a taper of the body being present the precise guiding of the body is always guaranteed due to the supporting rollers which are located on a rocker, and also if the amount of taper of the body is altered or even if such is not present at all. In order to press the rollers against the body a small force is sufficient, which force, however, shall remain constant, due to which the use of a spring is not suitable because its restoring spring force rises together with the stroke of the spring and accordingly the operating devices which keep the rollers pressed onto the body are preferably pneumatically operated cylinders in which the pressure can be controlled constantly.

If the forming of the longitudinal seam at the body is made by agency of a resistance seam roll welding machine, welding electrode rollers are located at the end of the feeding path between which rollers the body is fed through. Because rather large forces prevail during such welding it is necessary to counteract such forces along the last leg of the guiding path to which end a further pressing roller is located at each of the two opposing sides following the supporting rollers located at the rocker downstream relative to the direction of feed which can be pressed against by means of a separate pneumatic cylinder as operating device with a higher selectable pressure force independently of the supporting rollers.

BRIEF DESCRIPTION OF THE DRAWING

The invention will be better understood and objects other than those set forth above, will become apparent when consideration is given to the following detailed description thereof. Such description makes reference to the annexed drawings wherein;

FIG. 1 illustrates schematically a view of the guiding apparatus as seen from the end of the feeding path;

FIG. 2 is a side view of the guiding apparatus of FIG. 1;

FIG. 3 is a top view of the guiding apparatus at a first position of the body; and FIG. 4 is a top view of the guiding apparatus according to FIG. 3 at an altered position of the can body.

DESCRIPTION OF THE PREFERRED EMBODIMENT

The embodiment of the guiding apparatus illustrated in the drawings is intended for the guiding of a can body having a substantially rectangular cross-section with rounded corners and with a conicity, i.e. taper, which means that the cross-section of the body is relative to the direction of feed at its leading end smaller than at its trailing end. FIG. 1 is a top view of the front end of the can body 1. The edges 2 of the body which are to be welded into a longitudinal seam are located at the upper narrow side of the body 1 as seen in FIG. 1. At the level of these edges 2 to be welded together two respective supporting rollers 3 are located in succession relative to the direction of feed and at both opposite sides of the body 1 and having their rotating axes 4 supported in a rocker 5 which rockers are triangular in top view. At a vertical distance from the center of the connecting line between the two axes 4 of rotation the rocker 5 is supported by means of a pivot pin 7 on a transmission lever 6, i.e. the two axes 4 of rotation and the pivot pin 7 define the corners of a triangle within the rocker 5. FIG. 3 illustrates clearly that this transmission lever 6 is a double arm lever having a fulcrum point 8. The other end of the transmission lever 6 is coupled to an operating device in form of a pneumatic cylinder 9 for the production of a pressing force acting on the supporting rollers 3. FIG. 3 discloses that the above described design of the supporting rollers 3, of the transmission lever 6 and of the pneumatic cylinder 9 are mirror-inverted at the two opposite sides of the body 1.

The two welding electrode rollers 10 and 11 by means of which the longitudinal seam is formed when the body 1 is fed therethrough are illustrated in FIG. 2. Due to the large forces prevailing during the welding operation pressing rollers 12 located at opposite sides of the body 1 must exert a large pressing force onto the body directly ahead of this welding area. Therefore, each pressing roller 12 is located rotatably at the end of a double-arm transmission lever 13 of which the other end is coupled to an operating device in form of a pneumatic cylinder 14.

The two pneumatic cylinders 14 can be controlled independently from the two pneumatic cylinders 9 such that due to the separate supply by pressurized air the necessary pressing force can be generated by means of the pneumatic cylinder 14. For sake of clarity of the schematic illustration the transmission levers and pneumatic cylinders are not illustrated in FIGS. 1 and 2.

The supporting rollers 3 and the pressing rollers 12 comprise, such as is illustrated in FIGS. 1 and 2, at their circumferential surface an outer contour which corresponds to the shape of the rounded corners of the body 1. In order to provide support, further supporting rollers 15 abut the lower rounded corners of the body 1. The principle of operation of these supporting rollers by means of a respective transmission lever 16 and a pneumatic cylinder 17 is the same as the one described above with reference to the upper pressing rollers. Latter elements are illustrated in FIG. 1 on a schematic basic only. The two supporting rollers 15 extend at an angle of 45° relative to the vertical, such to correctly abut the rounded corner of the body by the correspondingly shaped circumferential surface of the roller.

A further supporting roller 18 is located between these two supporting rollers 15 and abuts against the lower narrow side of the body 1. The same principle of operation is also true for this supporting roller 18, and a transission lever 19 left away in FIG. 1 and illustrated only in FIG. 2 is coupled to a pneumatic cylinder acting as operating device. Accordingly, the body 1 is supported at its circumference in an exactly symmetrically distributed fashion which is a prerequisite for a precise interconnecting of the edges of the body by forming a longitudinal seam.

While there is shown and described a present preferred embodiment of the invention, it is to be distinctly understood that the invention is not limited thereto, but may be otherwise variously embodied and practiced within the scopoe of the following claims.

I claim:

1. An apparatus for the guiding in a machine of can bodies having a non-circular cross-section and specifically a cross-section having rounded corners, which cross-section is variable in an axial direction of the can, in which machine longitudinal edges of can bodies which are fed by a feeding mechanism are interconnected at an end of a path of feed by producing a longitudinal seam during which the edges of the bodies are maintained by guiding members in an overlapping state as required for such longitudinal seam, said apparatus comprising respective pluralities of rollers located at each oppositely located rounded corner of a can body for supporting the can body symmetrically and operative for guiding the can body in an area of the machine at which the edges are to be welded together, each of which rollers are supported on roller supports movable toward and away from the can body axis, and force controlling means for providing a controllable force which can be kept at a constant value to maintain said rollers in a pressing position which is automatically adjustable laterally relative to the direction of feed to maintain a constant pressing force against the can body as the can body cross-section varies in the direction of feed.

2. The apparatus of claim 1, wherein at each of the oppositely located rounded corners of the can body at least two respective supporting rollers are supported in one common rocker by their axes of rotation arranged in succession relative to the feeding direction, which rocker is pivotably supported at one end of a rotatably supported double arm transmission lever that is pivotably around a pivot axis extending parallel to said roller axes of rotation, and wherein the other end of said transmission lever is coupled to an operating means for producing a pressing force acting through said supporting rollers against the can body.

3. The apparatus of claim 2, wherein a pressing roller having the same shape as said supporting rollers is supported at one end of a further transmission lever and located relative to the direction of feed after said supporting rollers and approximately in the plane of the device for producing the longitudinally extending seam arranged at the end of the path of feed of the can bodies, which device includes a pair of welding electrode rollers, and wherein the other end of said transmission lever is coupled to a further operating means for producing a pressing force acting at said pressing roller against the can body.

4. The apparatus of claim 3, wherein said rockers including supporting rollers, said pressing rollers, said transmission levers and operating devices are positioned at mutually opposite sides relative to the plane of feed of the can bodies in a mirror-inverted fashion.

5. The apparatus of claim 4, in which all said operating means are pneumatic cylinders, and in which the pneumatic cylinders for operating the mutually oppositely located rockers supporting the supporting rollers and the pneumatic cylinders for said separate pressing rollers are included in separate pressurized air control circuits which are controllable independently from each other.

6. The apparatus of claim 2, wherein said supporting rollers and pressing rollers have a concave periphery for pressing against the formed can bodies having a substantially rectangular cross-section including rounded corners, and are located in a upper plane containing two of the corners, below which plane further supporting rollers are located and are operative to press onto two other corners and the surface of the body extending therebetween, which further supporting rollers are rotatably supported each at the end of a double-arm transmission lever each coupled to an operating means for producing a pressing force.

7. The apparatus of claim 6, in which said operating means are pneumatic cylinders, which pneumatic cylinders for said further supporting rollers for pressing against two other corners in a lower plane and against the surface of the body are included in separate pressurized air control circuits which are controllable independently from each other.

* * * * *